United States Patent [19]

Pizzino

[11] Patent Number: 4,976,087

[45] Date of Patent: Dec. 11, 1990

[54] METHOD OF FORMING FOOTING AND LAYING FIRST COURSE OF BLOCK

[76] Inventor: Edward Pizzino, P.O. Box 264, Hopedale, Ohio 43976

[21] Appl. No.: 129,460

[22] Filed: Dec. 7, 1987

[51] Int. Cl.[5] ..... E02D 27/00

[52] U.S. Cl. ..... 52/742; 52/169.1; 52/293

[58] Field of Search ..... 52/742, 747, 169.1, 52/293, 294, 742, 293, 747, 169.1, 244

[56] References Cited

U.S. PATENT DOCUMENTS

| | | | |
|---|---|---|---|
| 2,518,186 | 8/1950 | Rumble | 52/293 |
| 2,540,622 | 2/1951 | Langenberg | 52/293 |
| 2,815,656 | 12/1957 | Klein | 52/169.1 |
| 2,882,712 | 4/1959 | Carlson | 52/293 |
| 3,397,494 | 8/1968 | Waring | 52/293 |
| 3,834,094 | 9/1974 | Ferguson | 52/293 |
| 4,627,205 | 12/1986 | Hitchins | 52/294 |
| 4,756,133 | 7/1988 | Madray | 52/293 |

OTHER PUBLICATIONS

Concrete Masonry Age, Nov. 1960, pp. 11, 12, 20 and the cover page.

*Primary Examiner*—Henry E. Raduazo
*Attorney, Agent, or Firm*—Frease & Bishop

[57] ABSTRACT

A method of forming a concrete footing and laying a first course of concete block is disclosed. The method includes excavating a trench, placing a frame having longitudinal stringers in the trench and supporting reinforced steel from the frame. The frame stringers are leveled and a plurality of concrete blocks are supported on the stringers in spaced relationship. The trench is then filled with concrete to a level wherein the reinforced steel, frame and the bottom portion of the block and spaces between adjacent blocks are occupied with concrete. Thereafter additional courses of concrete block may be laid on the first course in traditional fashion.

6 Claims, 4 Drawing Sheets

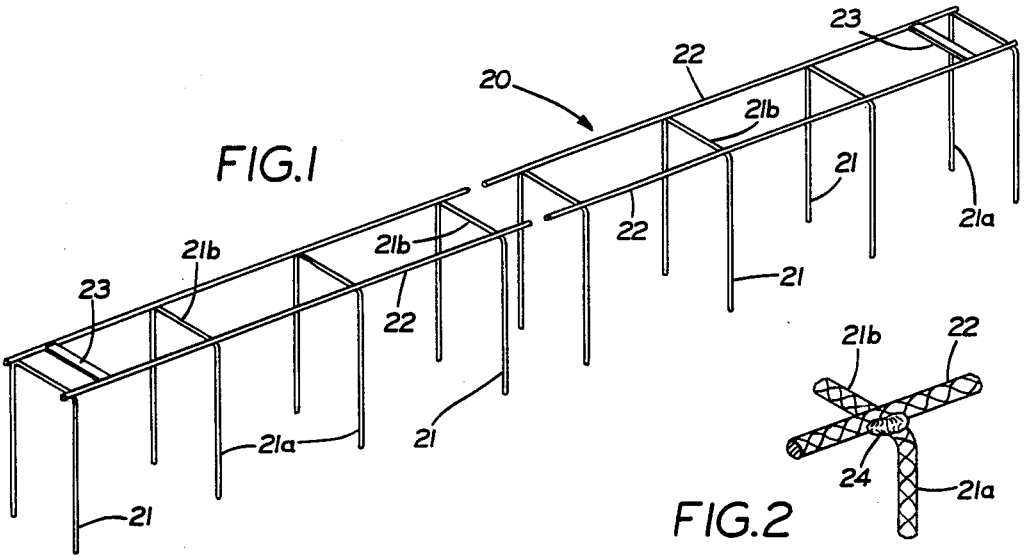
FIG.1
FIG.2
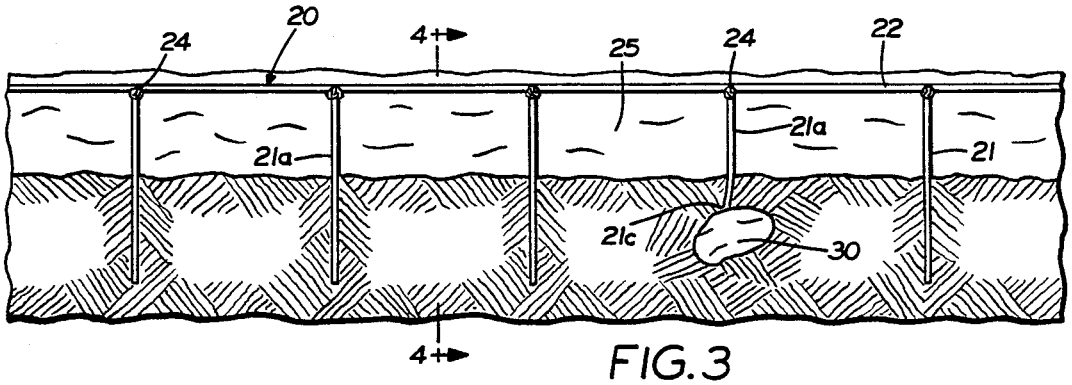
FIG.3
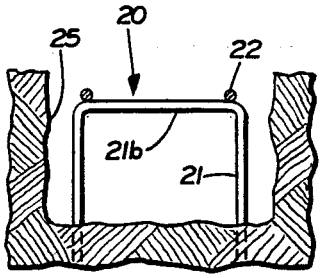
FIG.4
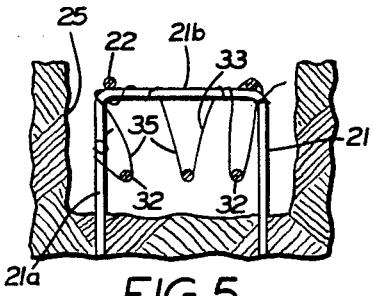
FIG.5
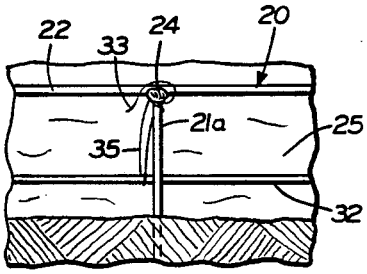
FIG.6
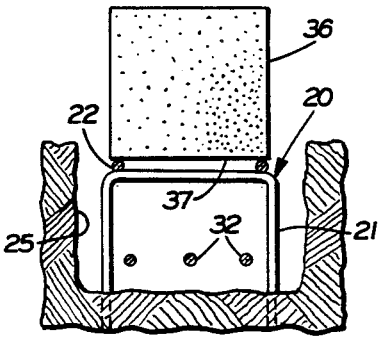
FIG.7
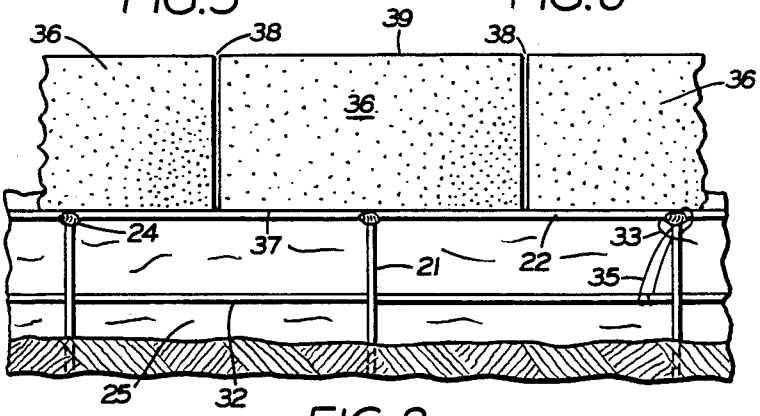
FIG.8

METHOD OF FORMING FOOTING AND LAYING FIRST COURSE OF BLOCK

BACKGROUND OF THE INVENTION

1. Field of the Invention

The invention relates to methods and procedures for building construction and more particularly the invention relates to a method of erecting or forming the footing and first course concrete block which provides the foundation for a building structure.

2. Description of the Prior Art

The customary procedure used to erect the foundation for a building structure includes the procedures of forming a trench in the ground at the location where the building is to be erected. Reinforcing steel, commonly called "rebar" in the industry, is supported in the trench to provide additional strength to the concrete footing. This rebar is required by various building codes in connection with building most, if not all, commercial structures and additionally a very large majority of residential structures employ rebars or reinforcing steel in forming the foundation.

After the reinforcing bar is supported in the trench at the proper level, concrete is poured in the trench to surround the rebar and is allowed to set. This setting normally takes a day to complete and can take longer.

After the concrete footing has set, a first course of concrete block is laid or erected on the set footing. This first course of block will normally require leveling procedures so that subsequent courses of block which are erected upon the first course to form a wall structure will be level. Since the footing concrete has set when the first course of block is laid, the joint between the concrete footing and the block to be laid will be a cold joint, because the block concrete and footing concrete do not set at the same time. Such cold joints are not as desirable or strong as if the concrete in the footing were partially or completely unset when the first course of block is laid up.

One obvious disadvantage of the standard procedure is that it is necessary to wait a day between pouring the concrete footing and laying the first course of block. Further, as already mentioned, a cold joint exists between the cement used to lay up the first course of block and the concrete booting.

Various devices have been proposed for supporting the reinforcing steel (rebar) which is used in most construction projects. U.S. Pat. Nos. 4,085,559 and 4,627,205 show devices used to support rebar in building foundation constructions. Likewise, U.S. Pat. No. 1,729,612 shows a device for supporting a rebar in the construction of a concrete floor. U.S. Pat. No. 3,104,600 illustrates a system of forming the joint in a concrete highway.

U.S. Pat. No. 3,318,059 discloses a system for forming a concrete footing which provides a level top surface to support the first course of block to be laid on the footing. This construction involves the use of a series of grade stakes which are placed in the footing trench prior to pouring the footing concrete. These grade stakes support an elongated plate which is leveled at the time of erection and ultimately becomes a part of the top surface of the footing.

U.S. Pat. No. 2,815,656 discloses a method of forming a wall construction that involves the insertion of a series of U-shaped supporting members in a footing trench which support a series of rebars. A small layer of concrete is poured in the bottom of the footing trench to stabilize the inverted U-shaped members and support the rebars. A corrugated wall member is supported on the inverted U-frame member and additional concrete is poured with a second set of rebars supported by transverse rods extending through the corrugated wall members. Concrete footing is then poured over the previously poured stabilizing portion and a series of vertical tie rods are installed in the wall which serve as a means of positioning the upper edge of the wall. A wooden form is also employed in this system.

From the standpoint of labor savings, which in today's building construction industry is a major building cost factor, it would be desirable to provide a system of erecting building foundations in which the concrete footing and first course of block can be accomplished in a more efficient manner than at present. At least two advantages will be obtained thereby. First, such a procedure will eliminate the necessity of waiting for the concrete footing to set prior to laying up the first course of block. Also, the cold joint between the cement used to bond the first course of block to the footing will be eliminated.

None of the prior art methods disclose a system in which a concrete footing can be erected by constructing the footing and first course of block in one unified procedure. Accordingly, a need has existed in the building construction industry to provide a system for more efficiently and effectively erecting a building foundation.

SUMMARY OF THE INVENTION

Objectives of the invention include providing a method of forming a concrete footing and laying a first course of block which can be accomplished in one continuous procedure, providing a frame member which is installed in a foundation trench to support both rebar and a first course of block, providing a method of leveling the first course of block by supporting the block on the previously leveled frame prior to pouring the concrete footing; providing a system in which the footing is poured after the first course of block is supported in proper position and enclosing the bottom portion of the previously supported block in the footing; providing a method and construction which eliminates time-consuming procedures employed in the prior art; and providing a system which solves problems and satisfies existing needs in a simple, effective an inexpensive manner.

These objects and advantages may be obtained by the method of forming a footing and laying the first course of block of the present invention, the general nature of which may be stated as including the steps of forming a trench in the ground at the proper building foundation location, placing a block rebar supporting frame in the trench, leveling the top of the frame, locating the frame top at the proper position for the bottom of the first course of block, supporting reinforcing steel in the trench from the frame, laying a first course of concrete block on the frame, which includes a series of individual blocks spaced apart from one another and pouring concrete in the trench to enclose the rebar frame, and bottom portion of the first course of concrete block.

BRIEF DESCRIPTION OP THE DRAWINGS

Preferred embodiments of the invention, illustrative of the best modes in which applicant has contemplated applying the principles, are set forth in the following description and shown in the accompanying drawings, and are distinctly and particularly pointed out and set forth in the appended claims.

In the drawings:

FIG. 1 is a perspective view of the frame member used in performing the methods of the present invention;

FIG. 2 is a fragmentary perspective view showing the inner connection between several parts of the frame member FIG. 3 is a longitudinal section illustrating a trench with the frame member of FIG. 1 placed in position., FIG. 4 is a transverse cross section taken on the line 4—4 of FIG. 3, FIG. 5 is a view similar to FIG. 4 showing rebars being supported by the frame;

FIG. 6 is a side elevation of the frame supporting the rebars as illustrated in FIG. 5;

FIG. 7 is a view similar to FIG. 4 showing a succeeding step in which the concrete blocks are supported by the frame prior to pouring the footing;

FIG. 8 is a side elevation of the step of the procedure illustrated in FIG. 7;

Similar numerals refer to similar parts throughout the various figures of the drawings.

DESCRIPTION OF THE PREFERRED EMBODIMENTS

Figure 10:
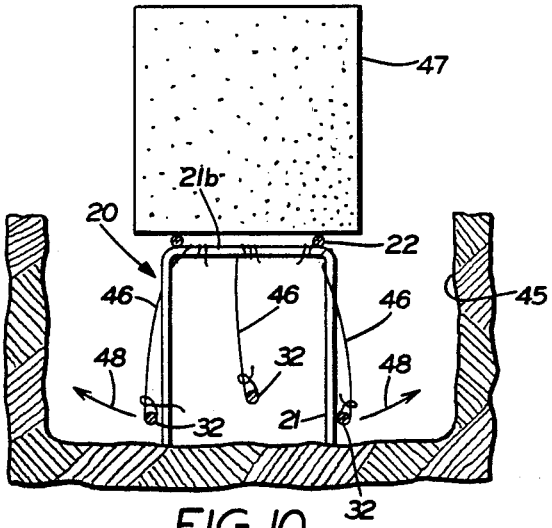
FIG. 10 is a view similar to FIGS. 5 and 7 in which an alternate method of supporting reinforcing steel is illustrated.
Figure 11:
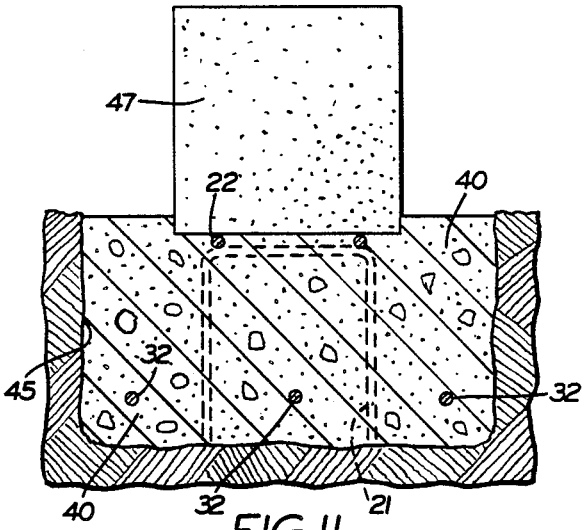
FIG. 11 is a view of the alternate from shown in FIG. 10, after the footing has been poured and the rebar positioned in the footing.
Figure 12:
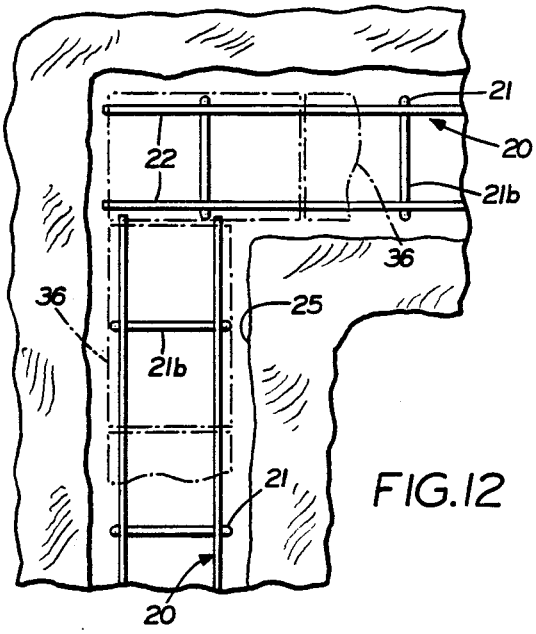
FIG. 12 is a top plan of a foundation corner employing the methods of the present invention.
Figure 13:
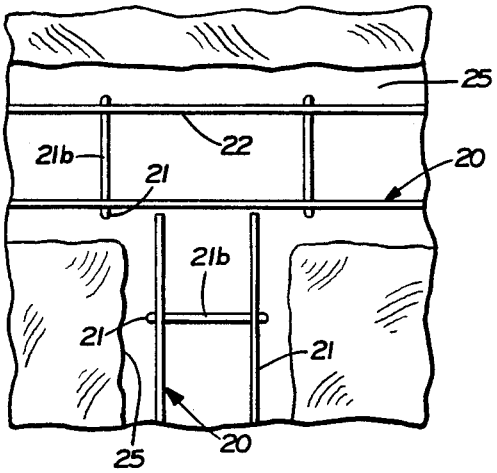
FIG. 13 is a top plan showing the perpendicular intersection of one wall with another.

The methods and procedures of the present invention are illustrated generally in FIGS. 3 through 9. An alternative step in the method is illustrated in FIGS. 10 and 11, and the use of invention at positions where courses of block intersect are illustrated in FIGS. 12 and 13. FIGS. 1 and 2 illustrate a unique frame device which is employed in the present invention and is an integral part of the method.

FIG. 1 illustrates a frame generally indicated at 20 which is formed of a plurality of inverted U-shaped frame supports 21 and a pair of spaced parallel stringer members 22. Frame 20 is constructed in convenient lengths whereby a pair of stringers 22 are held in spaced relation from each other by spacers 23 and the spaced stringer members 22 are respectively welded at the corners 24 of the inverted U supports 21 (FIG. 2). U supports 21 are spaced along the length of stringer members 22 a distance of 16 inches apart, which is the standard length of concrete block which is used in building construction. The spacing of U-shaped supports, therefore, automatically provides for correct positioning of U supports 21 with respect to concrete block position, as later described.

Each of U support members 21 includes support legs 21*a* and base 21*b* joining legs 21*a* together and is preferably formed from a suitable length of steel which is bent into the shape of a U. At the corner 24 where legs 21*a* join base 21*b*, stringer members 22 are welded to form the unitary frame indicated generally at 20.

In accordance with the methods of the present invention, a trench 25 of suitable depth is excavated in the ground at the location at which a building foundation is to be constructed. Trench 25 will typically be 12 inches in depth. Support legs 21*a* of U support 21 are prefabricated in a suitable length of approximately 15 inches to 18 inches, and the frame may be fabricated up into any convenient length of, say, approximately 20 feet. In those situations where a shorter length of frame may be needed, stringer members 22 may be cut to provide a frame of shorter length. The cut may be done in the field by either a torch or a hacksaw.

After trench 20 is excavated, frame 20 is placed in trench 25 along the location where the course of block for the foundation is to be located. Support legs 21*a* are pushed into the ground and each of support members 21 is positioned at a location which will be at the approximate center of each of the standard 16 inch concrete blocks that will be used to form the first course of block. In the event that a rock or other obstacle interferes with the correct placement of U legs 21*a* into the ground (FIG. 3), leg 21*a* may be cut as at 21*c* so as to avoid rock 30 and permit the proper positioning of frame 20 in trench 25. After frame 20 is positioned in trench 25, suitable leveling means are used to insure that stringers 22 are located in level position at least one inch below the ground level of the excavation. The leveling of stringers 22 may be accomplished by any standard means, such as a transit and rod. The positioned frame 20 in the excavated trench 25 is shown in FIGS. 3 and 4.

After establishing the correct position of frame 20, reinforcing bars of steel 32 are positioned in trench 25. In FIGS. 5 and 6, three rebars 32 are illustrated and are supported between U legs 21*a* and U base 21*b*. Rebars 32 are preferably supported in the following fashion: A wire 33 is attached to frame 20 at approximately the position of the attachment of one of the U members 21 to stringer 22 by twisting wire 33 around both these members at that point. A loop 35 is formed in the wire extending downwardly from base member 21*b* and wire 33 is looped back up and around U base 21*b*. A second support loop 35 is formed and the wire again looped and twisted around U base 21*b*, and a third downwardly extending loop 35 is formed and the end of the wire is then twisted or attached to either the stringer 22 or the U support leg 21*a*. The positioning of rebars 32 in the three downwardly extending loops 35 is illustrated in FIGS. 5 and 6. It should be apparent that other means of supporting rebars 32, such as providing elongated S hooks, could be employed. However, the twisted wire method shown in FIGS. 5 and 6 proves to be quite convenient and inexpensive and makes use of material commonly available at construction sites.

After correctly positioning rebars 32, as shown in FIGS. 5 and 6, a plurality of concrete blocks 36 are placed on frame 20. Concrete blocks 36 are shown in FIGS. 7 and 8. One standard concrete block measures 8 inches high by 8 inches wide by 16 inches long. Other sized blocks are commonly used in the construction industry and the present invention is adapted to be used with such different sized blocks. However, the standard block length is 16 inches irrespective of its width and height. In any case, stringer members 22 when prefabricated to form frame 20, as shown in FIG. 1, are spaced slightly less than 8 inches apart so that an 8 inch wide concrete block, as well as larger sized blocks, can be placed and supported on frame 20 when frame 20 is positioned in the excavated trench 25.

Blocks 36 are positioned in a manner so that the bottom surface 37 of block 36 rests upon the parallel extending stringers 22. The center of each block 36 is positioned above one of U support members 21, as shown in FIG. 8, which U support members are, as mentioned above, spaced approximately 16 inches apart along the length of stringers 22. The blocks 36 are laid along the length of stringers 22 and are spaced a distance apart from each other as at 38, and this spaced position is maintained by inserting a spacer member (not shown) between each of the individual blocks of the first course. The top surface 39 of blocks will be level because they are supported by stringers 22 that have been previously placed in level positions.

Figure 9:
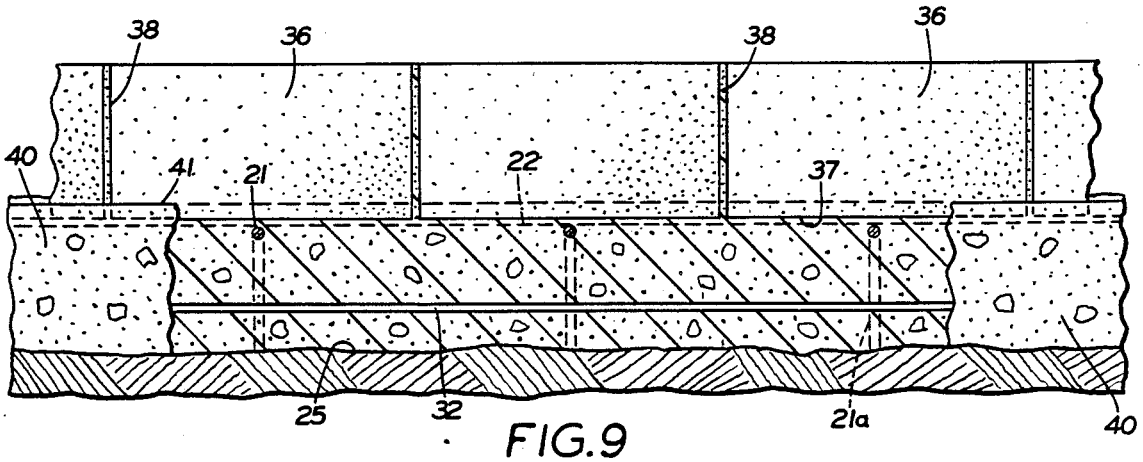
FIG. 9 is a side elevation, partly in section, illustrating the completed footing in which the first course of block is supported and in which concrete has been poured into the footing trench to enclose the frame, reinforcing bar and bottom portion of the first course of concrete block.

After frame 20 has been correctly positioned, rebars 32 supported, and blocks 36 placed in correct position, all as illustrated in FIGS. 7 and 8, concrete may be poured into the excavated trench 25 and in between each of the individual blocks in spaces 38, as shown in FIG. 9. The concrete is typically poured to the approximate grade or level of the excavation and the bottom surface 37 of each block 36 will be embedded in footing 40 formed by the poured concrete. The top surface 41 of footing 40 will, after the concrete has been poured and set, be slightly above the established level of the bottom surface 37 of the first course of block 36. FIG. 9 illustrates the structure as completed with footing 40 in position and enclosing or embedding the bottom surface 37 of the first course of concrete block 36. Additional courses of block may then be laid upon the first course in the standard manner to form a wall or other structure as desired after a short setting period.

FIG. 10 illustrates an alternative method or adaptation of the methods of the present invention where a block larger than the 8 inch block referred to above is employed. In FIGS. 10 and 11, a concrete block 47 of 8 inch by 12 inch by 16 inch dimension is illustrated. The same frame 20 is employed to support the block 47 and to incorporate the rebar 32 into the footing 40. Some rules of thumb are used to determine the dimensions of the trench for various size blocks. In general, trench 25 is formed to be approximately twice as wide as it is deep and twice as wide as the block width and at least as deep as the block width. Further, local building codes may require specific block size or that a footing be of a specific depth, for example 12 inches irrespective of block size.

Returning to FIGS. 10 and 11, trench 45, illustrated in FIG. 10, is substantially wider than that illustrated in FIG. 4 and it is, therefore, necessary to have the rebars 32 spaced differently than as shown in FIG. 5. Therefore, each of the individual rebars 32 are hung by suspending them from wires 46, as shown in FIG. 10. The larger block 47 is then placed on stringers 22 with the center of the block similarly positioned ever each of the U supports 21. Block 47, while wider than block 36 is, however, formed at the standard length of 16 inches. As the concrete 40 is placed in trench 15, rebars 32 may be moved outwardly in the direction of arrows 48 in FIG. 10 to the approximate position shown in FIG. 11 to obtain the final desired positioning of rebars 32 in the footing 40. It can, therefore, be seen that the methods and frame 20 of FIGS. 1 through 9 may be used with equal effectiveness for blocks of varying sizes.

FIGS. 12 and 13 illustrate in a general way the manner in which the frame 20 is placed in an excavation 25 at those positions where courses of block intersect, as at a building corner. Frame 20 is merely cut at the proper position along stringers 22 and the frame placed in correct position, for example as shown in FIG. 12, to form a corner. In FIG. 12, the first course of blocks 36 are shown in dot-dash line as they would be positioned on frame 20 prior to pouring footing 40. FIG. 13 illustrates the positioning of frame 20 at locations where a wall or partition intersects a second wall. The blocks are supported on frame 20 in the same manner as for a straight course of block prior to pouring concrete to form a footing 40. The concrete is poured into trench 25 in the same manner as illustrated in FIGS. 3–9.

During the construction of the footing 40 and first course of block 36 or 47 employing the methods of the present invention, it is desirable to have available at the construction site a cutting torch so that the frame 20 may be cut at desired positions to either form corners, T intersection, as shown in FIGS. 12 and 13, or to enable or to facilitate the bending of the U support legs 21 in the event an obstruction is present.

Further, it is desirable that a transit be employed to determine the level of the frame 20 during the construction methods of the present invention, to insure that the first course of block will not only be level but positioned at the correct height with respect to the grade of the ground surrounding the footing and foundation.

By employing the methods of the present invention, it is possible for two workmen to form and pour a foundation for a typical residential home in one half day or less. By employing the procedures of the prior art, at least two days would be necessary. While employing the methods of the present invention entails the added cost of the steel used to fabricate frame 20, this extra steel cost is more than offset by the savings in time and labor. Furthermore, the methods described above and which employ frame 20 are equally suitable for all sizes of commercially used concrete block used to form walls in the construction industry today. Thus, the invention is equally suitable for residential construction, as well as for commercial construction, for example, where an industrial building is constructed.

Several distinct advantages are obtained by the methods of the present invention. First, the methods can be accomplished by using the same materials that are normally available and used at a construction site with the addition of frame member 20. Frame member 20, however, is normally prefabricated into suitable transportable lengths and is cut to correct length at the construction site. The use, however, of frame 20 does not require a special skilled laborer nor the use of equipment which is not normally found at a typical construction site. Frame 20, which is constructed of steel, is easily cut with a hacksaw or cutting torch, both items which are normally found at construction sites. The advantages, however, obtained by the use of frame 20 include the obvious savings in labor, the savings in time, and the convenience of laying the first course of block in position where it is automatically level and at the correct height, as opposed to those procedures commonly employed in the prior art. Further, the footing and first course of block can be accomplished in one unified procedure thus eliminating the aforementioned cold joint. Accordingly, the methods of the present invention provide distinct advantages over prior art procedures and provide economical, efficient and desirable results not heretofore available by using prior art methods.

In the foregoing description, certain terms have been used for brevity, clearness and understanding, but no unnecessary limitations are to be implied therefrom beyond the requirements of the prior art, because such terms are used for descriptive purposes and are intended to be broadly construed.

Moreover, the description and illustration of the invention are by way of example, and the scope of the invention is not limited to the exact details of the construction shown or described.

Having now described the features, discoveries and principles of the invention, the manner in which the improved method of forming footing and laying first course of block is constructed, assembled and operated, the characteristics of the new methods, and the advantageous, new and useful results obtained, the new and useful methods, steps and procedures are set forth in the appended claims.

I claim:

1. Method of forming footing and laying first course of block to form a building foundation including the steps of:

(a) excavating an elongated trench in the ground at a desired location;

(b) providing a frame, said frame including a pair of spaced longitudinal stringers and a plurality of inverted U-shaped frame support members attached to and spaced along the stringers;

(c) inserting the U-shaped support members in the trench with said stringers extending in the direction of the excavated trench elongation;

(d) locating the stringers at a position below the ground level surrounding the trench;

(e) leveling the stringers;

(f) supporting reinforcing steel from the frame;

(g) placing a first course of a plurality of concrete blocks on the stringers in spaced relationship with each other and with block bottoms adjacent to the stringers;

(h) locating the center of each block in the course over one of the U-shaped support members; and (i) pouring concrete in the excavation to fill the excavation to a level in which the frame, reinforcing steel and block bottoms are enclosed in the poured concrete.

2. The method as set forth in claim 1 including the steps of checking the level of the block after placing the block on the stringers and pouring the concrete.

3. The method as set forth in claim 2 including the step of laying additional courses of concrete block on the first course of block after the poured concrete has partially cured.

4. Method of forming footing and laying first course of block to form a building foundation including the steps of:

(a) excavating an elongated trench in the ground at a location;

(b) providing a frame, said frame including a pair of spaced longitudinal stringers and a plurality of inverted U-shaped frame support members attached to and spaced along the stringers;

(c) inserting the U-shaped support members in the trench with said stringers extending in the direction of the excavated trench elongation., (d) leveling the stringers;

(e) supporting reinforcing steel from the frame;

(f) placing a first course of a plurality of concrete blocks on the stringers in spaced relationship with each other and with block bottoms adjacent to the stringers;

(g) locating the center of each block in the course over one of the U-shaped support members; and (h) pouring concrete in the excavation to fill the excavation to a level in which the frame, reinforcing steel and block bottoms are enclosed in the poured concrete.

5. Method of forming a concrete footing and laying first course of block including the steps of excavating a trench in the ground, placing a frame having longitudinally extending stringers in the trench, supporting reinforcing steel from the frame in the trench by hanging the steel from loops attached to the frame, leveling the stringers, supporting a plurality of concrete blocks on the stringers in end-to-end spaced relationship before pouring the concrete in the trench, filling the trench with concrete to a position enclosing the reinforcing steel and frame and stringers and bottom portion of the block and spaces between adjacent blocks with concrete to form the complete footing and first course of block.

6. The method of forming a concrete footing and laying first course of block as set forth in claim 5 in which the step of supporting the reinforced steel includes the step of positioning reinforced steel includes the step of positioning the supported steel in the concrete at a desired position while the concrete is being poured.

* * * * *